United States Patent [19]

Friedrich

[11] 4,062,467

[45] Dec. 13, 1977

[54] COLLAPSIBLE TRANSPORT CONTAINER

[76] Inventor: Wolfgang E. Friedrich, Burgsteinfurter Damm 1, 4442 Bentheim, Germany

[21] Appl. No.: 693,877

[22] Filed: June 8, 1976

Related U.S. Application Data

[63] Continuation of Ser. No. 541,576, Jan. 16, 1975, abandoned.

[30] Foreign Application Priority Data

July 27, 1974 Germany ..... 2436254

[51] Int. Cl.[2] ..... B65D 7/24

[52] U.S. Cl. ..... 220/7

[58] Field of Search ..... 220/6, 7

[56] References Cited

U.S. PATENT DOCUMENTS

| | | | |
|---|---|---|---|
| 2,221,504 | 11/1940 | Beasley | 220/6 |
| 2,998,157 | 8/1961 | Holmes | 220/6 |
| 3,360,180 | 12/1967 | Venturi | 220/6 |
| 3,446,415 | 5/1967 | Bromley | 220/7 |
| 3,516,592 | 6/1970 | Friedrich | 220/7 |
| 3,611,994 | 10/1970 | Bailey | 220/6 |
| 3,628,683 | 12/1971 | Friedrich | 220/6 |

*Primary Examiner*—George E. Lowrance
*Attorney, Agent, or Firm*—Karl F. Ross

[57] ABSTRACT

A collapsible treatment container has a rectangular elongated base whose outer edge is formed at the rim provided with hinges on which pivot a pair of opposite side walls and another pair of opposite end walls. The side walls and end walls are both centrally formed with stiffening ribs terminating at their bottom in abutments engageable with formations on the base so as to prevent pivoting of these walls beyond an erected position perpendicular to the base, but allowing them to be collapsed and flattened down over the base. The end walls are formed with two spaced sockets and the side walls have tongues of projections engageable with the sockets so as to rigidly lock the assemblies together. The sockets at each corner of the assembly are so arranged and constructed that the tongue or tongues closer to the hinge are engaged in their respective socket or sockets before the other so as to insure easy assembly of the structure. Between the two sets of sockets and tongues there is provided a resilient latch that holds the structure together when erected.

2 Claims, 7 Drawing Figures

FIG. 4
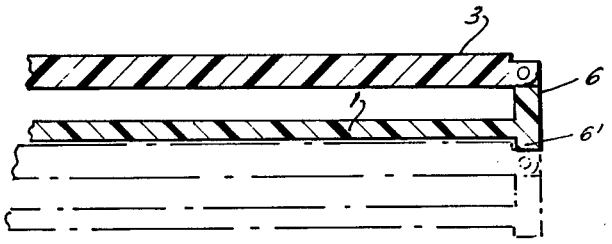
FIG. 5
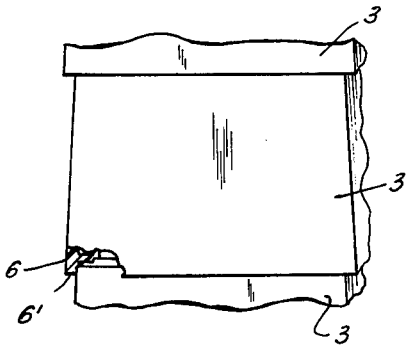
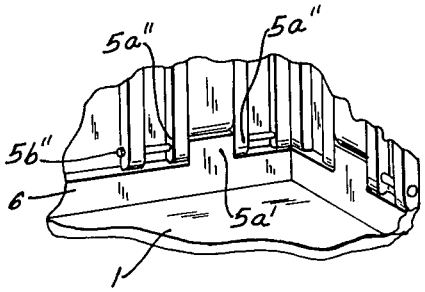
FIG. 6
FIG. 7
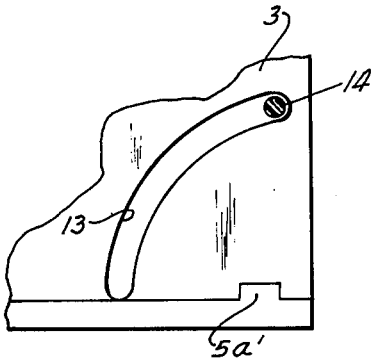

COLLAPSIBLE TRANSPORT CONTAINER

This is a continuation of application Ser. No. 541,576, filed Jan. 16, 1975, now abandoned.

FIELD OF THE INVENTION

The present invention relates to a collapsible transport container. More particularly this invention concerns a container which can be collapsed from a box shape in which it is usable to transport produce or the like into a flat shape allowing it to be returned to the sender taking up a minimum amount of space.

BACKGROUND OF THE INVENTION

A transport container is known which has a generally rectangular base plate on which are hinged four wall panels that can be pivoted from a flattened position up into an erect position extending generally perpendicular to the base plate. The walls are held in place relative to each other by various forms of latches and guide formations.

Such transport containers are rarely sufficiently rigid to transport relatively heavy materials. In addition they are frequently difficult to set up and tend to fall into the collapsed position when empty. Furthermore their production cost is frequently relatively high and they readily invite pilferage as they come apart easily. Another disadvantage is that it is relatively difficult to stack such containers so as to form a rigid assembly both with the containers erected and filled, or empty and collapsed.

OBJECTS OF THE INVENTION

It is therefore an object of the present invention to provide an improved transport container of the above-described general type.

Another object is the provision of an inexpensive and stable vessel-like container.

Yet another object is the provision of such a container which is extremely strong yet which can be produced at minimal cost.

Yet another object is to provide a collapsible transport container which readily can be stacked both when collapsed and erected so as to form a stable pile.

SUMMARY OF THE INVENTION

These objects are attained according to the present invention in a collapsible transport container comprising a generally rectangular base plate having four edges on each of which is hinged a wall such that each wall is displaceable between a flattened position generally parallel and overlying the base plate and an erected position generally perpendicular to the base plate. When erected a vessel in formed opened away from the base plate. The walls are arranged as two pairs of opposite walls with the inner faces of the walls of each pair being generally parallel to each other in the erected position and perpendicular to the inner faces of the other pair. Sockets are provided on each of the walls of one of the pairs and projections are provided on each of the walls of the other pair. These projections are each receivable in a respective socket only in the erected position of the walls to lock the walls together relative to one another. In this manner an extremely rigid and rugged container is formed.

According to yet another feature of this invention there is provided an abutment on the base plate at each of the edges outside of the respective hinge and a formation on the outer face of each of the walls which is engageable with the respective abutment only in the erected position thereof for limiting pivoting of the respective wall outwardly beyond the erected position.

In accordance with another feature of this invention the sockets and projections are provided in pairs at each corner of the transport container one above the other. In this manner maximum rigidity and holding power is obtained.

According to this invention the hinges of one of the pair of opposite walls have pivot axes which lie in a plane which is above the similar plane defined by the pivot axes of the hinges for the other pair of walls. Such an arrangement allows the lower pivoted walls to be dropped down first with the other walls pivoted down on top of them so as to form a flat and extremely compact assembly when collapsed.

According to yet another feature of this invention the abutments on the base plate and/or the formations on the outer face of each of the walls are formed as reinforcing ribs. These ribs extend in accordance with this invention most of the way up the side so as to further rigidify and strengthen the container.

In accordance with another feature of the present invention the abutments and formations are provided between the hinges generally at the midpoint of each of the walls. This provides necessary support and rigidity at just the location where the prior-art collapsible containers were weakest. Such an arrangement insures that a bowing and/or other disadvantageous deformation of the transport container is almost completely eliminated, with the container retaining its shape even when heavily loaded.

The containers according to the present invention are readily stackable both when full and empty. This is effected by making at least one of the pairs of walls of slightly trapezoidal shape so that the upper rim of an erected box can readily fit within the lower rim of an overlying box. Similarly the hinge regions of at least one of the pairs of walls are stepped so that even when collapsed these stepped portions will lock within the rim at the lower edge of the box and therefore ensure a snug interfitting. This arrangement insures that both when erected and collapsed the transport container according to the present invention can be formed into stable stacks that are readily handled by, for instance, a lift truck or the like.

BRIEF DESCRIPTION OF THE DRAWING

The above and other objects, features, and advantages will become more readily apparent from the following, reference being made to the accompanying drawing in which:

FIG. 4 is a vertical section illustrating how the transport containers according to the present invention are stackable in the collapsed position;

FIG. 5 is an end diagrammatic view illustrating how the containers are stackable when erected;

FIG. 6 is a perspective detail view of an inside corner of an erected box according to this invention; and FIG. 7 is a partly sectional end view illustrating a feature of the invention.

SPECIFIC DESCRIPTION

Figure 1:
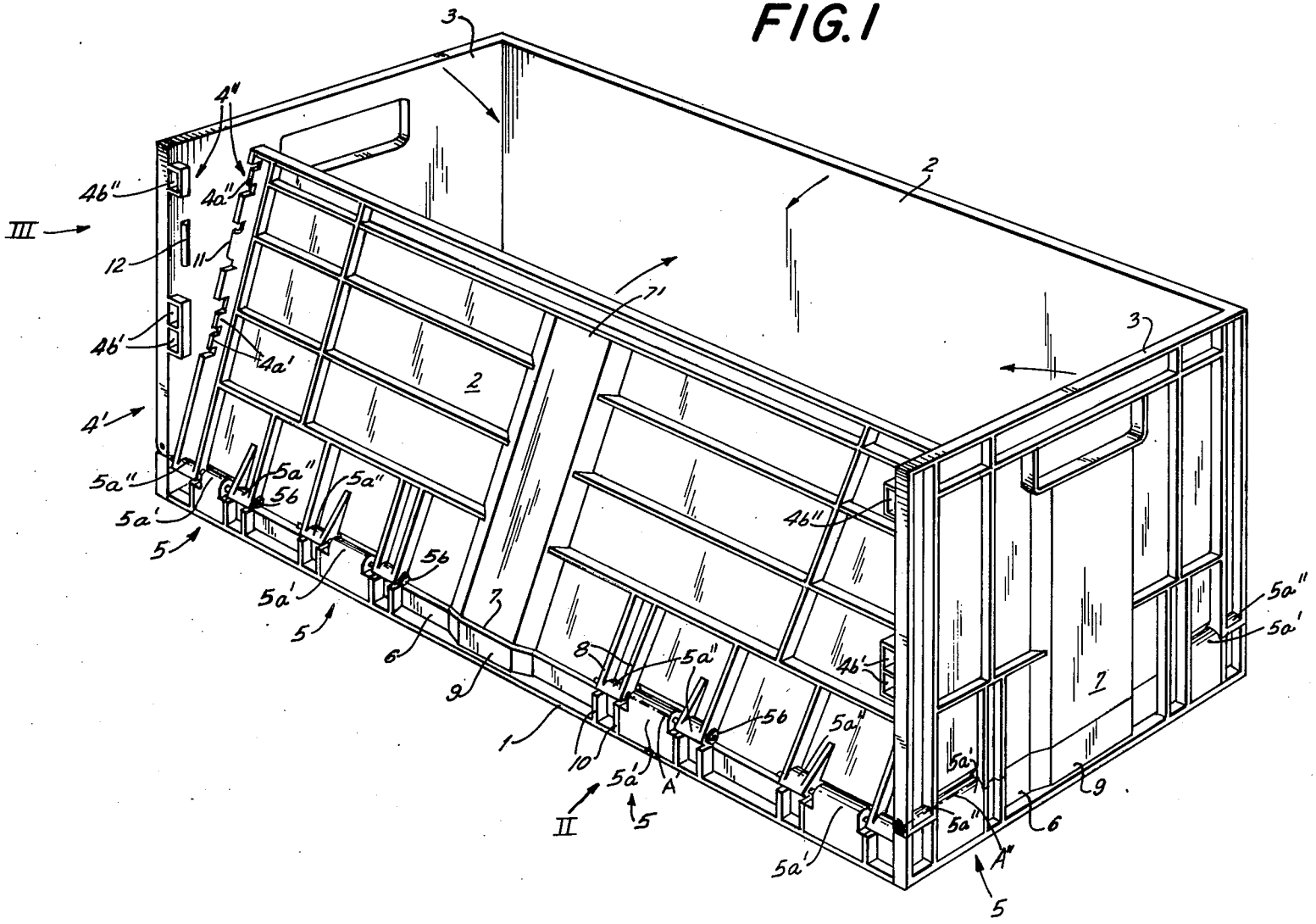
FIG. 1 is a perspective view of a transport container according to the present invention.
Figure 2:
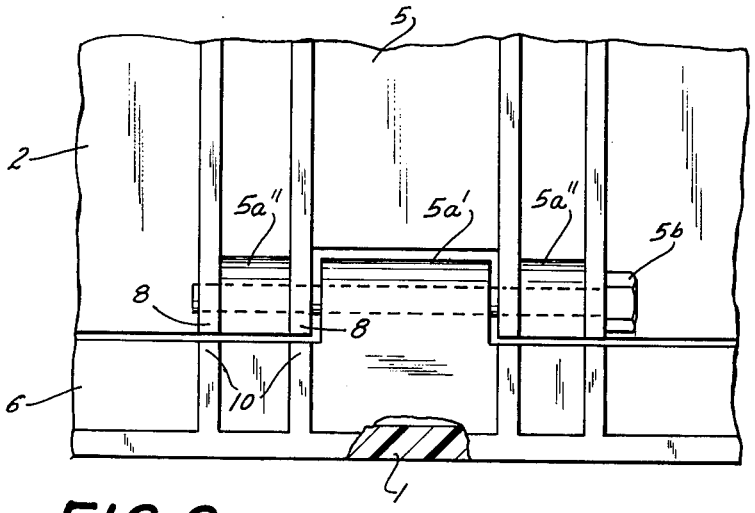
FIGS. 2 and 3 are large scale views corresponding to the details indicated by arrows II and III, respectively, of FIG. 1.

As shown in FIG. 1 a transport container according to the present invention comprises a generally planar base plate 1 and a pair of side walls 2 and end walls 3 hinged thereon. The walls 2 and 3 are connected via hinges 5 each comprising a central eye 5a' formed on the respective edge of the base 1 and a pair of outer eyes 5a'' flanking this eye 5a'. A pintle 5b passes the eyes 5a' and 5a'' of each hinge 5. The base plate 1 is formed with an upwardly and downwardly extending rim 6 on which the eyes 5a' are formed.

Each of the side walls 2 is connected at each of its lateral edges with a respective one of the end walls 3 by means of a lower latch 4' and an upper latch 4''. Each lower latch 4' is comprised of two relatively long projections 4a' formed on the wall 2 and two sockets 4b' carried on the walls 3 and receiving the projections 4a'. The upper latches 4'' are formed by a single relatively short projection 4a'' receivable within complementary sockets 4b'' on the wall 3. The relative lengths of the projections 4a' and 4a'' insure that as the wall 2 is swung up the projections 4a' will start to seat within the sockets 4b' before the projection 4a''. In this manner a very neat and easy assembly is assured.

Figure 3:
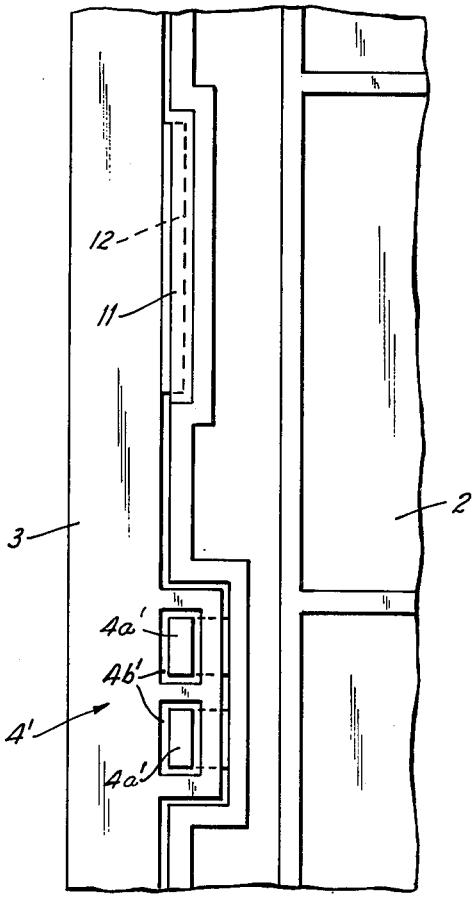

Between the latches 4' and 4'' there is provided a resiliently deformable ridge 12 receivable behind a similar ridge or rib 11 carried on the corresponding lateral edge of the wall 2. When assembled as shown in FIG. 3 the rib 11 passes over the rib 12, deforming the latter, and thereby locks the two walls 2 and 3 in place relative to each other. This structure insures that the container will remain erect even when empty, but that a force from outside can disconnect the two walls 2 and 3 when desired.

A vertical rib 7' formed in the middle of each of the walls 2 and 3 between the hinges 5 is formed at its lower end as a flat abutment 7 outside the pivot axes A' and A'' of the walls 2 and 3 respectively. A similar abutment or formation 9 formed on the edge 6 of the base plate 1 is engageble flatly with this abutment or formation 7 when the respective wall 2 or 3 is in the erected or vertical position so as to prevent it from pivoting further outwardly and so as to support it rigidly when the container is erected.

Each of the eyes 5a'' of each hinge 5 is formed at its lower end with a pair of squared-off abutments 8 that can flatly engage a similar abutment 10 formed on the rim 6 of the base 1. These abutments 8 and 10 are formed as vertical ribs on the container and function similarly to the formations 7 and 9 to prevent outward swinging of the walls 2 and 3 beyond their erect positions.

The container is made entirely of an inexpensive synthetic-resin such as polyethylene or polyurethane. The walls 2 and 3 are ribbed throughout for maximum rigidity with minimum weight. The pintles 5b alone are made of metal, aluminum being employed. FIG. 4 indicates how the end walls 3 are stepped at 3' so that when collapsed as shown they fit within the lower edge 6' of the rim 6. This allows the containers to be superposed in a stable stack when collapsed.

FIG. 5 indicates diagrammatically how the walls 3 are slightly trapezoidal so that their upper ends fit within the lower ends of overlying containers. The walls 2 are similarly trapezoidal so that a stack of erected containers is extremely stable.

FIG. 6 shows the inside corner of the container wherein the pintle 5b passing through the eyes 5a' and 5a'' is only visible from inside thereby making it impossible to open the container from outside by withdrawing the pintle 5b and pulling off one of the walls 2 or 3. Such an arrangement greatly improves the security of the system when stacked as shown in FIG. 5 surrounded by a steel strap.

The arrangement shown in FIG. 7 has a semicircular slot 13 formed in the inner face of the end wall 3 and receiving the end of a pin 14 carried on the side of one of the walls 2. Such an arrangement insures a sure guiding of the walls 2 and 3 relative to each other and thereby makes for a very stable assembly.

I claim:

1. In a transport container comprising:

a rectangular base plate having four edges and an upstanding rim extending around said edges;

a respective wall along each of said edges mounted on said base plate, said walls being provided in two pairs of opposite walls and being reversibly swingable from an erect position in which said walls are perpendicular to said base plate to recumbent positions wherein said walls overlie said base plate and lie upon one another;

arcuate grooves formed on inner faces of the walls of one pair and a pair of outwardly projecting pins formed on the edges of the walls of the other pair guided in said grooves to enable outward swinging of the walls of said other pair along said one pair after the latter have been swung into their erect positions;

respective mating latch formations along the angularly adjoining edges of said walls for engagement when the walls of said other pair are swung into their erect positions; and respective hinges swingably mounting each of said walls to said base plate with the hinge axes of said one pair being disposed above the hinge axes of said other pair;

the improvement wherein:

one wall of each of the angularly adjoining edges is formed with a pair of sockets located respectively above and below said latch formations;

the other wall of each of the angularly adjoining edges is formed with a pair of projections located other than said pins respectively above and below said latch formations matingly engageable with the respective sockets of the first mentioned wall of each of the angularly adjoining edges;

said sockets and projections at each of the angularly adjoining edges being disposed one above the other;

said sockets and projections are so constructed and arranged that, at each of the angularly adjoining edges, the lower projection is received in its socket before the upper projection is received in its socket as said other pair of walls are swung into their erect positions;

said latching formations at each of the angularly adjoining edges are spaced above the respective lower projection and socket and below the respective upper projection and socket; and said latching formations at each of the angularly adjoining edges are so constructed and arranged as to engage subsequent to the entry of the respective lower projection and its socket but prior to the entry of the respective upper projection into its socket as the walls of said other pair are swung into their erect positions.

2. The improvement defined in claim 1 wherein:

said base plate is provided with an abutment at each of said edges outside the respective hinge and an outer face of each of said walls is provided with a formation engageable with the respective abutment only in the erect position thereof for restricting swinging of the respective wall outwardly beyond its erect position;

each of said walls is formed with a reinforcing rib having an end constituting the respective formation; and each of said hinges is provided with a pintle accessible only within the container.

* * * * *